United States Patent [19]

Lindsey

[11] Patent Number: 4,934,114

[45] Date of Patent: Jun. 19, 1990

[54] LIGHTWEIGHT LINE TOWER KIT

[75] Inventor: Keith E. Lindsey, La Canada, Calif.

[73] Assignee: Lindsey Mfg. Co., Azusa, Calif.

[21] Appl. No.: 149,938

[22] Filed: Jan. 28, 1988

Related U.S. Application Data

[63] Continuation-in-part of Ser. No. 901,010, Aug. 27, 1986.

[51] Int. Cl.[5] ..... E04H 12/08

[52] U.S. Cl. ..... 52/40; 52/298; 52/637; 52/648; 403/363; 403/380

[58] Field of Search ..... 52/651, 40, 637, 638, 52/648; 182/178; 403/380, 363, 339

[56] References Cited

U.S. PATENT DOCUMENTS

| | | | |
|---|---|---|---|
| 422,036 | 2/1890 | Phelps | 52/40 |
| 840,947 | 1/1907 | Mansfield | 52/651 |
| 1,136,274 | 4/1915 | Rigoli | 52/651 |
| 1,141,160 | 6/1915 | Waite | 52/651 |
| 1,653,055 | 12/1927 | Macomler | 52/651 |
| 1,687,979 | 10/1928 | Goodrich | 52/40 |
| 1,847,421 | 3/1932 | Austin | 51/40 |
| 1,914,065 | 6/1933 | Bauer | 52/651 |
| 1,974,659 | 9/1934 | Sala | 52/40 |
| 2,074,548 | 4/1937 | Humphrey | 52/637 |
| 2,232,268 | 2/1941 | Rawson | 52/40 |
| 2,790,524 | 4/1957 | Herrschaft | 52/651 |
| 2,920,476 | 1/1960 | Sinfrock | 52/40 |
| 3,112,015 | 11/1963 | Anderson | 52/637 |
| 3,368,319 | 2/1968 | Werner et al. | 52/637 |
| 3,540,111 | 11/1970 | Wainwright | 52/40 |
| 4,378,175 | 3/1983 | Hasselgvist et al. | 52/298 |

FOREIGN PATENT DOCUMENTS

| | | | |
|---|---|---|---|
| 13814 | of 1928 | Australia | 52/40 |
| 188085 | 2/1956 | Austria | 52/40 |
| 417624 | 8/1925 | Fed. Rep. of Germany | 52/40 |
| 381655 | 7/1940 | Italy | 52/651 |

OTHER PUBLICATIONS

D. Sherman "500 KV on Tubular Steel Poles for San Diego Gas and Electric" Mar. 20–21, 1984; pp. 1–12.

D. Sherman "Economics of Cross Country Transmission Lines Using Tubular Steel H-Frames" (no date); pp. 1–23.

E. B. Kurtz, T. M. Shoemaker "The Lineman's and Cableman's Handbook" 1981, Sixth Edition; Section 20.

*Primary Examiner*—Michael Safavi

*Attorney, Agent, or Firm*—Christie, Parker & Hale

[57] ABSTRACT

Disclosed is a kit of low cost, light weight, corrosion resistant components, including a plurality of extruded members, certain ones of which components are factory preassembled into climbable and unclimbable tower units selected one of which are adapted to be rigidly connected end-to-end by overlapping couplings into a tower at an installation site to support a power line or other load. The couplings and the overlapping surfaces of the tower units have teeth that mesh to lock the couplings in place. The tower is specially suitable for erection in confined areas to heights in excess of one hundred feet to support power conductors. A number of components are selectively attachable to the tower in a wide variety of ways to support high tension insulators in suspension and/or cantilever fashion and to anchor guy cabling to the tower.

36 Claims, 8 Drawing Sheets

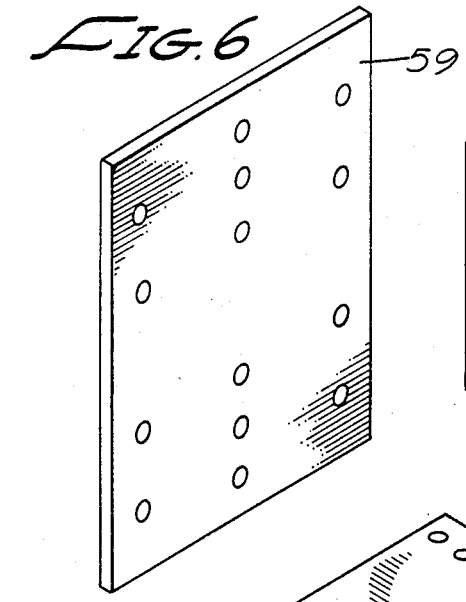
FIG. 6
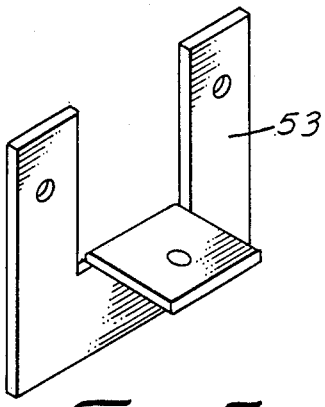
FIG. 7
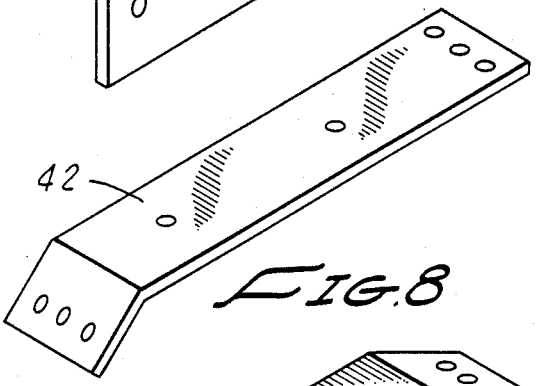
FIG. 8
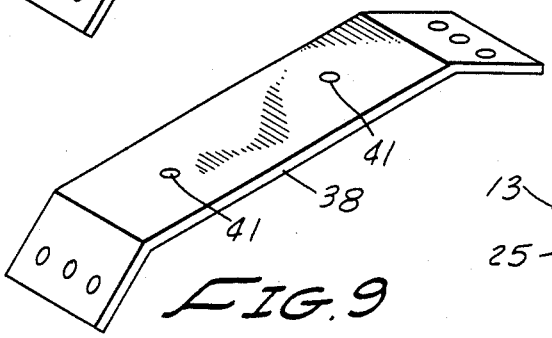
FIG. 9
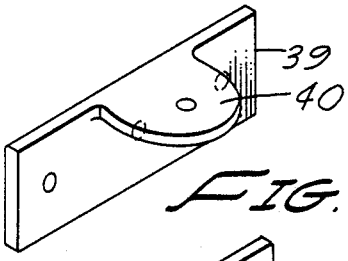
FIG. 10
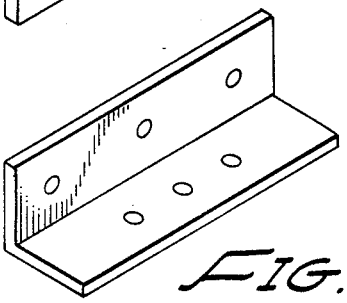
FIG. 11
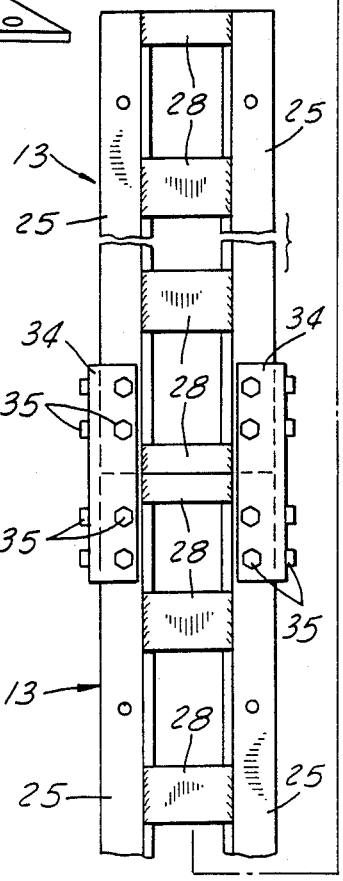
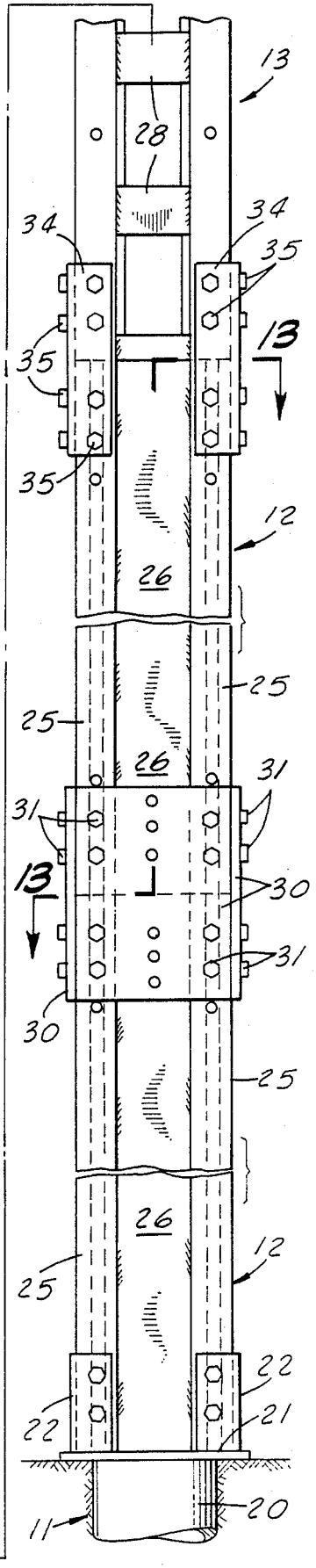
FIG. 12

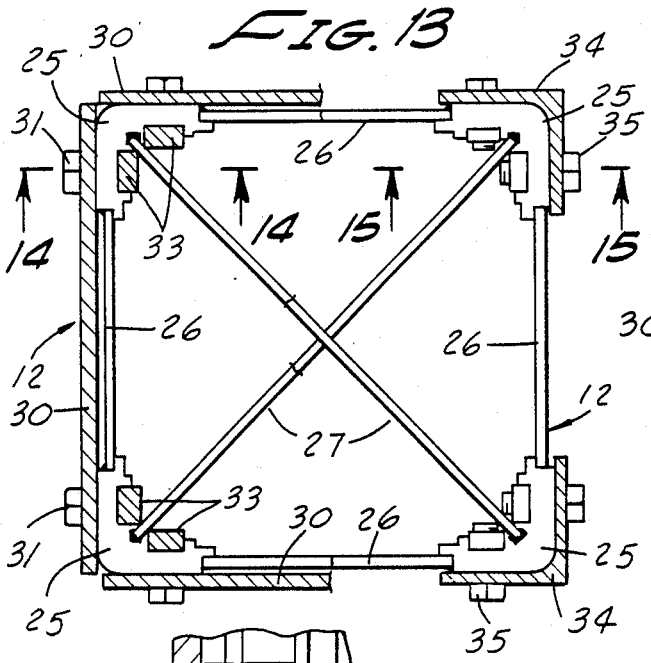
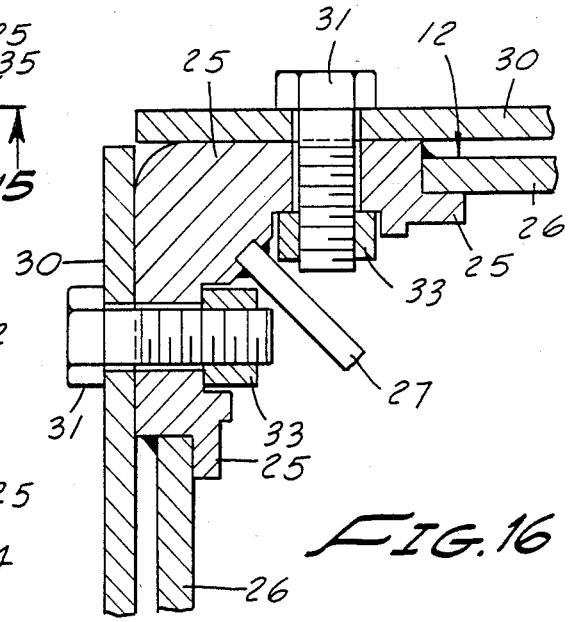
FIG. 16
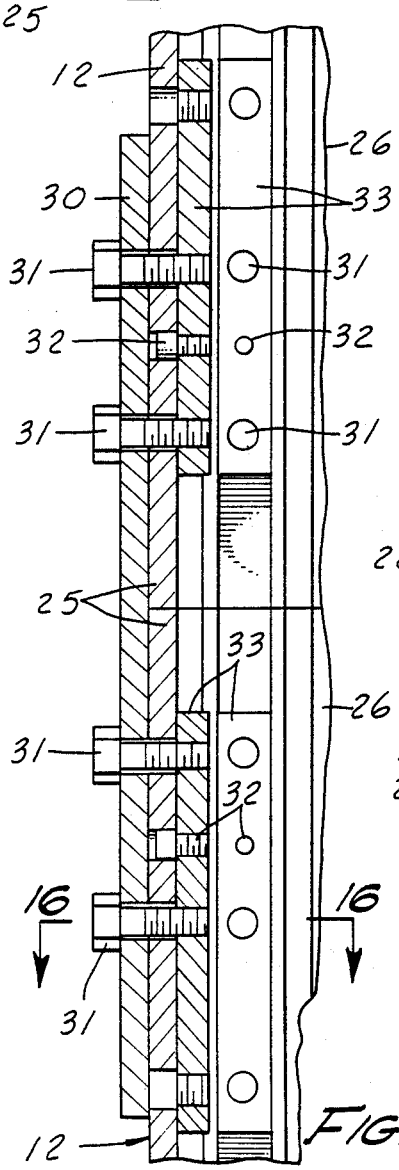
FIG. 14
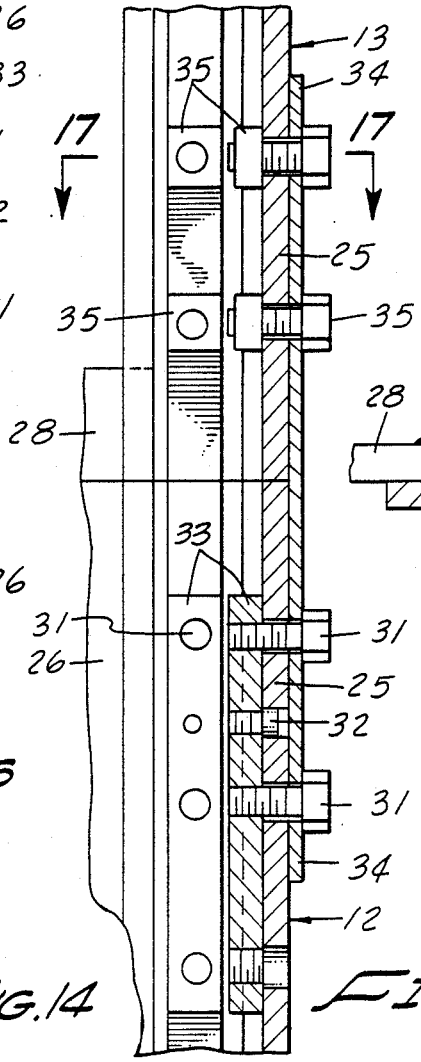
FIG. 15
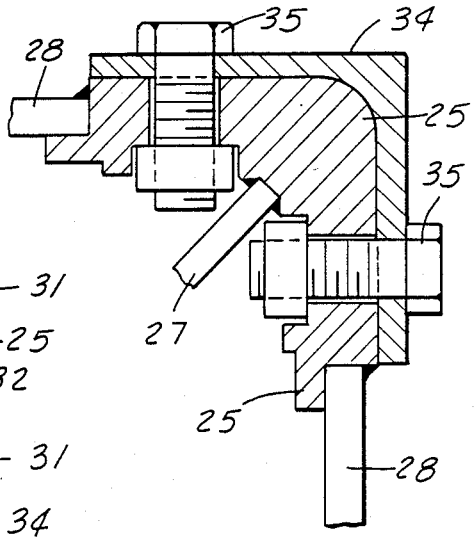
FIG. 17

LIGHTWEIGHT LINE TOWER KIT

CROSS-REFERENCE TO RELATED APPLICATIONS

This is a continuation-in-part of application Ser. No. 06/901,010 filed Aug. 27, 1986.

BACKGROUND OF THE INVENTION

The support of relatively high tension power conductors particularly in congested areas presents serious problems owing in major part to restrictions imposed by the local environment. Tower structures ranging in heights from fifty to one hundred and twenty five feet are customarily required and oftentimes the foundation area is very restricted or is located near other structures rendering it difficult to bring in heavy duty erection equipment or to utilize conventional tower structure. Three types of structures are in general use, namely wooden poles. steel poles and reinforced tower structures. Wooden poles are the least expensive but their erection in restricted areas often imposes serious problems and hazards. Wooden poles have a limited life even under favorable conditions and, under unfavorable conditions, have an undesirably short life. Concrete and steel towers can be assembled at the site but are extremely costly and require the use of equipment oftentimes difficult to bring to the site. Furthermore the cost can be excessive and typically fifteen to twenty times the cost of a wooden pole.

SUMMARY OF THE INVENTION

The present invention avoids the serious shortcomings and disadvantages of prior practice including those referred to above and others well known to those skilled in this art. To this end there is provided a kit of low cost lightweight modular components of unusually long life readily and inexpensively installable by simple equipment. The two major components of the kit include a preassembled unclimbable unit and one or more preassembled climbable units rigidly securable together in end-to-end relation. A variety of auxiliary components are selectively attachable to the modular tower units to support power conductors in a wide variety of well known and commonly employed patterns. All major components are desirably formed of high strength aluminum alloy anchorable to the tower units by threaded fasteners. The preassembled modular units include a plurality of extruded corner members interconnected directly to one another by welding or by spanner plates. The unclimbable unit includes generally imperforate spanner plates whereas the climbable units are interconnected by cross pieces functioning additionally as climbing steps for workmen.

A feature of the invention is the joint construction for connecting the units together. The joint is made by abutting the units end-to-end and securing thereto couplings that overlap portions of the length of the units adjacent their abutting ends. Preferably, the couplings and the overlapping surfaces of the tower units have teeth that mesh to lock the couplings in place and thereby resist shear forces exerted on the couplings.

The power conductors may be supported from the tower while suspended from the outer ends of cross arms or from the outer ends of cantilever supported insulators. In some instances it may be desirable to employ a pair of towers in side by side relation interconnected by cross ties or bracing with the power conductors suspended from a cross arm interconnecting the upper ends of the two towers.

The invention towers also are equally suitable for other uses encircling a dead end support for power conductors.

Accordingly, it is a primary object of this invention to provide a unique kit of components including a plurality of factory fabricated tower modules adapted to be readily assembled at an installation site in a minimum of space and with a minimum of simple equipment.

Another object of the invention is the provision of a kit of lightweight, corrosion resistant metal components readily assembled in the field into a power line support of a desired height utilizing prefabricated modular tower units.

Another object of the invention is the provision of a modular tower unit of tubular cross section formed from a plurality of extruded metallic elements including means rigidly interconnecting the same.

Another object of the invention is the provision of a low cost load carrying tower structure adapted to be erected in the field from factory preassembled modular units including at least one unclimbable lower unit and one or more climbable upper units rigidly interconnectible in end-to-end relation.

Another object of the invention is the provision of a kit of lightweight high strength components selectively interconnectible at a power line site in any of a wide variety of ways.

Another object of the invention is the provision of a kit of components including factory preassembled units, various combinations of which are selectively adapted for assembly in the field to provide a supporting structure to suit the requirements of a particular location.

Another object of the invention is the provision of a kit of modular tower components adapted to be interconnected in the field and including components selectively attachable to the upper end of the tower to support power line insulators in suspension, tension and cantilever fashion.

Another object of the invention is the provision of a modular tower structure formed from a plurality of extruded members interconnected in a tubular configuration by transverse members interconnecting a pair of extruded members by weldments.

These and other more specific objects will appear upon reading the following specification and claims and upon considering in connection therewith the attached drawing to which they relate.

Referring now to the drawing in which a preferred embodiment of the invention is illustrated:

FIG. 6 is a perspective view of a plate usable to interconnect adjacent climbable units, to mount cantilever insulators or for other purposes;

FIG. 7 is a perspective view of a component usable to connect a cross arm to the tower;

FIGS. 8, 9, 10 and 11 are perspective views of kit components usable for various purposes including connecting guy cables to the tower;

FIG. 12 is a view on an enlarged scale taken on FIG. 1 showing details of hardware interconnecting the climbable and unclimbable modules;

FIG. 13 is a cross sectional view taken along the broken line 13—13 on FIG. 12;

FIG. 14 is a cross sectional view on an enlarged scale taken along line 14—14 on FIG. 13;

FIG. 15 is a cross sectional view on an enlarged scale taken along line 15—15 on FIG. 13;

FIG. 16 is a view on an enlarged scale taken along line 16—16 on FIG. 14;

FIG. 17 is a view on an enlarged scale taken along line 17—17 on FIG. 15;

The annexed drawings show the components constituting the invention kit, selected ones of which can be assembled in the field to provide a variety of supporting structure, illustrative ones of which are shown in FIGS. 1, 18, 19, 20, 21, 22 and 23. Although each of these is shown in use to support power line insulators and conductors, it will be understood that the kit components can be assembled to support load bearing structures for many other purposes.

Figure 1:
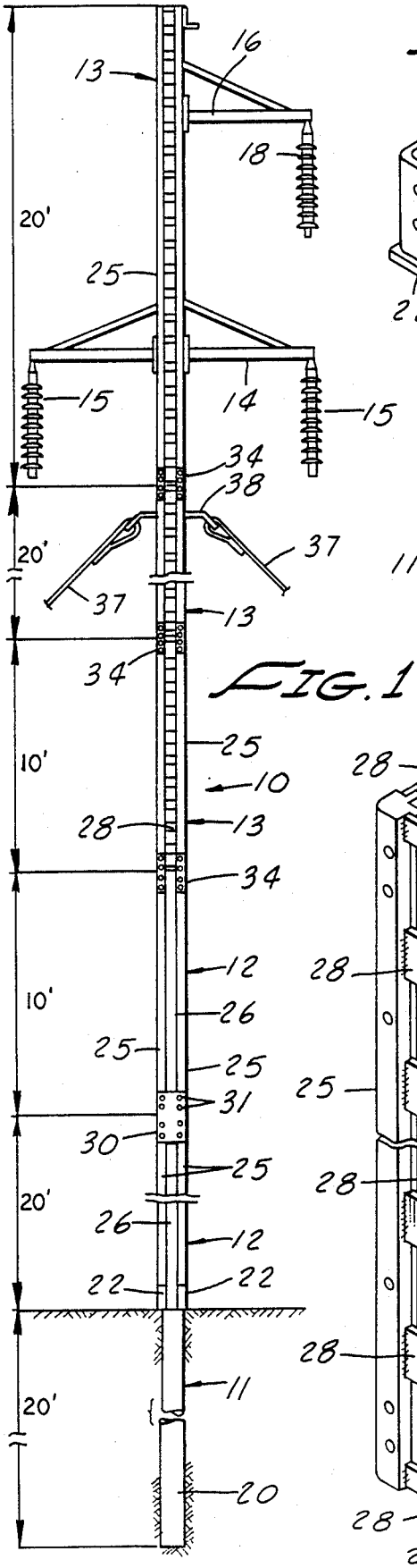
FIG. 1 is an elevational view of a load supporting tower assembled from components including modular units in accordance with the principles of this invention.
Figure 2:
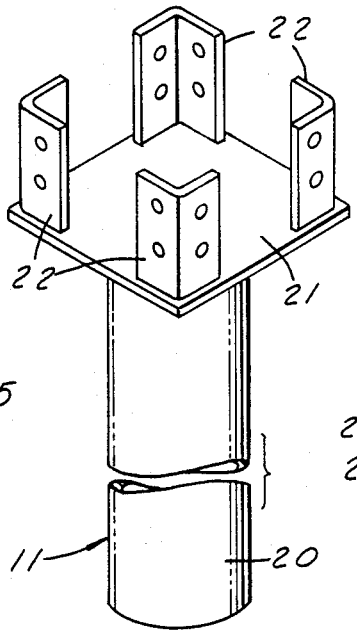
FIG. 2 is a fragmentary perspective view of a foundation unit supporting the FIG. 1 tower structure.
Figure 3:
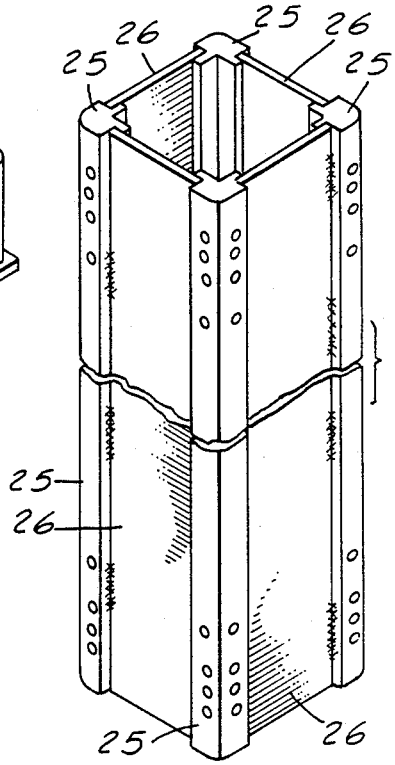
FIG. 3 is a perspective view on an enlarged scale of a prefabricated unclimbable modular unit.

As shown in FIG. 1, the tower, designated generally 10, includes a tubular foundation module 11, a pair of prefabricated unclimbable modules 12, 12, and a plurality of prefabricated climbable modules 13, 13 rigidly interconnected in axial alignment. A long tubular cross arm 14 traverses the upper end of the upper portion of the tower and supports a pair of insulators 15, 15 in suspension whereas a shorter tubular cross arm 16 extends from one side of the tower tops and supports a third insulator 18.

Modules 11, 12 and 13 are connected together by joints made by abutting the modules end-to-end and securing thereto couplings that overlap portions of the length of the modules adjacent their abutting ends. In the following description, the couplings take three exemplary forms, namely angle irons 22, bridging plates 30, and angle irons 34. The described joint is compact, as distinguished from flanged joints, and can be used to connect power pole units or sections having uniform cross-section, as distinguished from slip joints.

The foundation module 11 comprises a tube 20, the major portion of which is buried in the ground at the installation site. Welded crosswise of the upper end of tube 20 is a plate 21 having upright steel angle irons 22 welded to its corners having bores for fasteners rigidly securable to the lower end of modular unit 12. Modules 11 and 12 abut each other end-to-end. Angle irons 22 overlap a portion of the length of unit 12 adjacent its abutting end and is secured to unit 12 by fasteners not illustrated in the drawings.

Modular unit 12 comprises a plurality of extruded aluminum corner members 25 preferably but not necessarily extending parallel to one another and interconnected by plates 26 welded thereto. Plates 26 are preferably substantially imperforate thereby forming with corner members 25 a closed, i.e. imperforate, outer surface that makes modules 12 unclimbable by unauthorized persons. As is best shown in FIG. 13, corner members 25 are preferably interconnected by internal cross bracing ties 27 extending diagonally of the interior of the modules as is best shown in FIG. 13.

Figure 4:
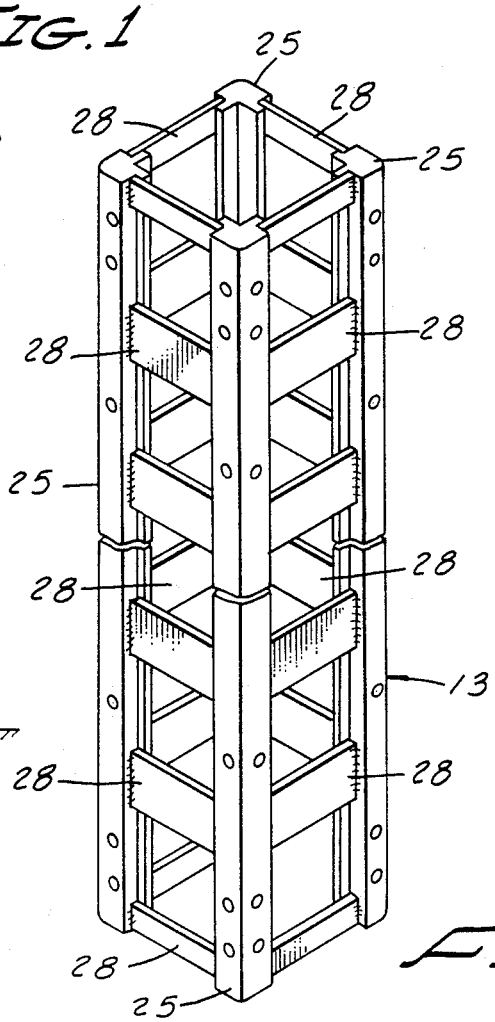
FIG. 4 is a perspective view on an enlarged scale of a climbable modular unit shown in FIG. 1.

The climbable prefabricated modules 13 shown in FIG. 4 include similar extruded corner members 25 rigidly interconnected in a tubular arrangement by step-forming cross members 28 conveniently spaced to form a ladder usable by service personnel. As illustrated in FIG. 4, the spacing between cross members 28 forms an open, lattice work outer surface that makes units 10 climbable. Although not shown in FIG. 4, it will be understood that modules 13 also preferably include diagonal cross bracing welded to the corner members.

Typically, the prefabricated modules are made in units or sections of convenient length, such as 20 feet, although they may be made in any of various shorter lengths if desired. Normally, a single 20 foot unclimbable section 12 suffices to prevent unauthorized persons from climbing the tower, but if the tower is located closely adjacent building structures a pair of unclimbable modules may be desirable. In this event they are interconnected by four bridging plates 30 by cap screws 31 extending through holes in the plates 30 and in corner members 25 and into the threaded bores of anchor plates 33 held assembled to the interior of corner members 25 as by cap screws 32 in the manner shown in FIG. 14. The threaded bores are provided in anchor plates 33 so the workmen do not have to apply nuts to the fasteners for bridging plates 30. The interconnected modules are abutted end-to-end. Bridging plates 30 overlap portions of the length of the modules adjacent their abutting ends and are secured thereto by caps screws 31.

Figure 5:
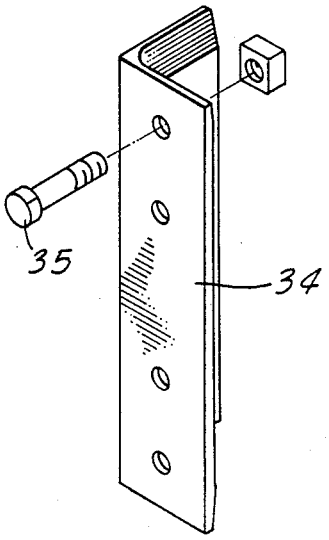
FIG. 5 is a perspective view of one of the joint members interconnecting some of the modular tower units.

The climbable modules 13 are rigidly anchored to one another and to the uppermost end of a unclimbable module 12 in the manner best shown in FIGS. 12 and 15 using the angle irons 34 shown in FIG. 5. Since the imperforate panels 26 of a module 12 make it difficult for the workman to apply nuts to the fasteners for the lower ends of angle irons 34, the upper end of the modules 12 are also provided with anchor plates 33 held thereto by cap screws 32 in the manner shown in FIG. 15. However, workmen do have access to the interior of modules 13 and therefore nuts and bolts 35 can be employed.

Modules 12 and 13 are abutted end-to-end. Angle irons 34 overlap portions of the length of modules 12 and 13 adjacent their abutting ends and are secured to the overlapping portions of modules 12 and 13 by cap screws 31 and nuts and bolts 35, respectively.

The kit provided by this invention is useful in providing support towers of a wide range of lengths as, for example, between 25 and 125 feet or more. Towers of any substantial height carry heavy loads and should be rigidly supported in an upright position by guy cables employed in any suitable number and at suitable levels. One typical arrangement is shown in FIG. 1 wherein the guy cables 37 are connected to the opposite ends of an anchor plate 38 extending crosswise of the tower and made as shown in FIG. 9. This strip is secured to the tower as by a pair of the angle members 39 shown in FIG. 10. The horizontal leg 40 of this member is boltable to a respective one of the holes 41 spaced to either side of the midlength of strip 38. The vertical legs of member 39 are of course securable by bolts to the tower corner members 25. A alternate guy cable anchor strip 42 is shown in FIG. 8 and is useful where a horizontal tie cable is to be attached to one end of the strip and a guy cable to the other end. For example, see such a strip mounted crosswise of the top of the tower shown in FIG. 20 and used as an anchorage for the end of a neutral or grounding conductor 44. Another strip 42 is also there shown for use as the anchorage for the dead end insulator 43.

Figure 18:
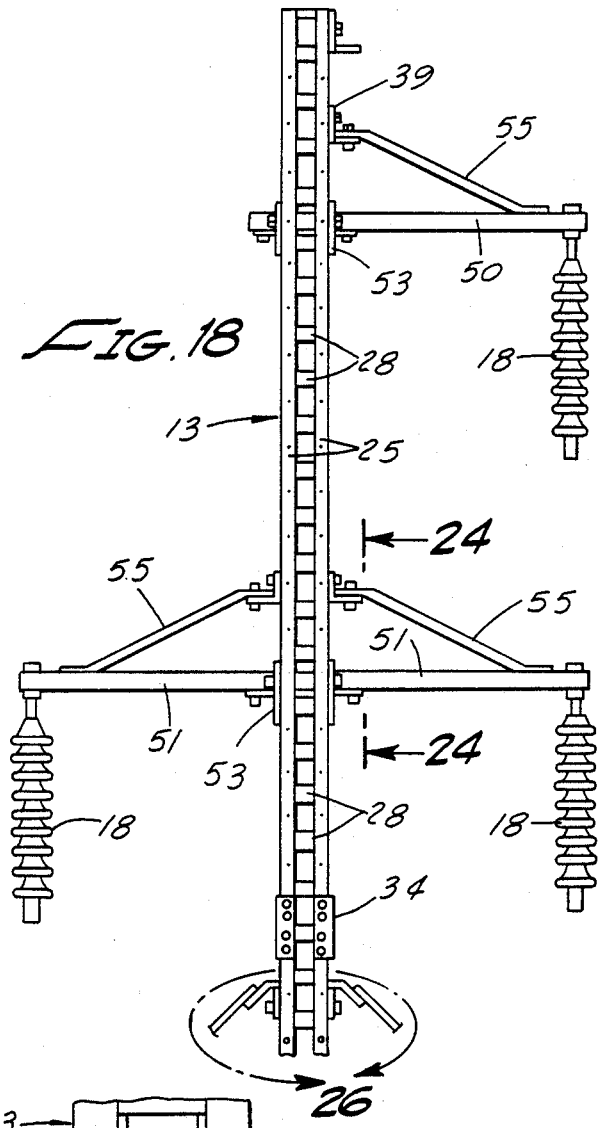
FIG. 18 is a fragmentary elevational view of the upper end of a tower showing one mode of supporting three insulators in suspension from a pair of tubular cross arms.

Reference will now be had to FIGS. 18, 24, 25 and 23, showing different modes of using tubular cross arms to support suspended insulators. FIG. 18 shows cross arms of two different lengths, the shorter 50 arm being used to support a single insulator from its outer end and the longer arm 51 projecting equal distances outwardly from the opposite sides of the tower and supporting a pair of insulators 18, 18. As shown, the cross arms are tubular and rectangular in cross section and project through the modules 13 to which they are anchored by the U-shaped brackets 53 best shown in FIG. 7. The legs of these brackets are rigidly secured to a pair of the corner members 25. Reinforcing bracing 55 preferably connects the outer ends of the cross arms to an overlying portion of the tower by means of the brackets 39 shown in FIG. 10.

Figure 19:
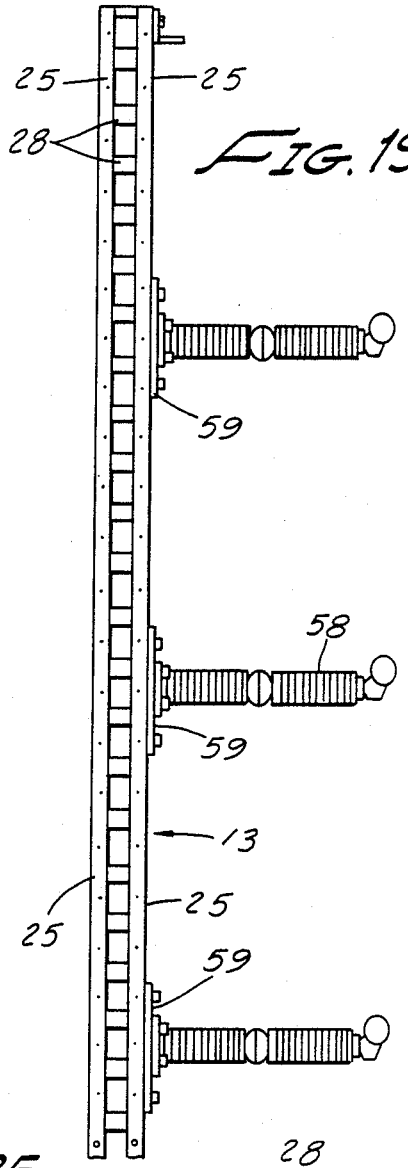
FIG. 19 is a view similar to FIG. 18 but showing three power line insulators supported cantilever fashion.
Figure 24:
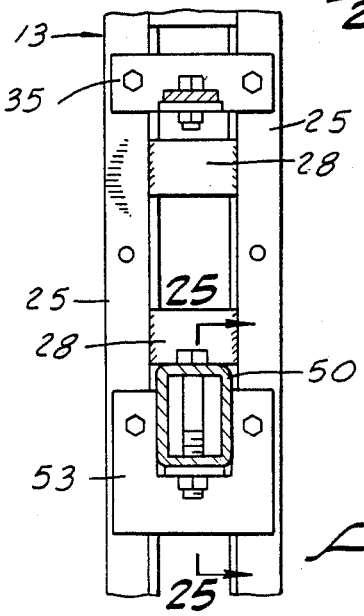
FIG. 24 is a cross sectional view on an enlarged scale taken along line 24—24 on FIG. 18.
Figure 25:
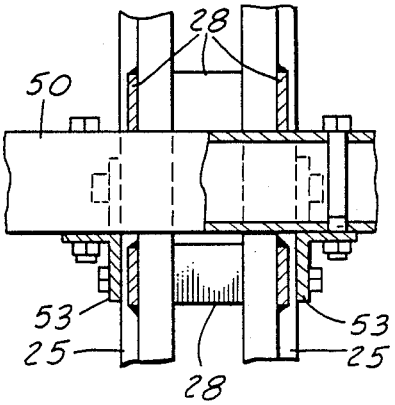
FIG. 25 is a cross sectional view on an enlarged scale taken along line 25—25 on FIG. 24.
Figure 26:
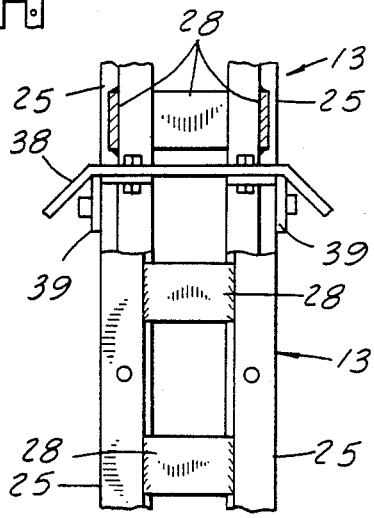
FIG. 26 is a cross sectional view on an enlarged scale taken on a horizontal plane as indicated by the dot and dash line at 26 in FIG. 18.
Figure 20:
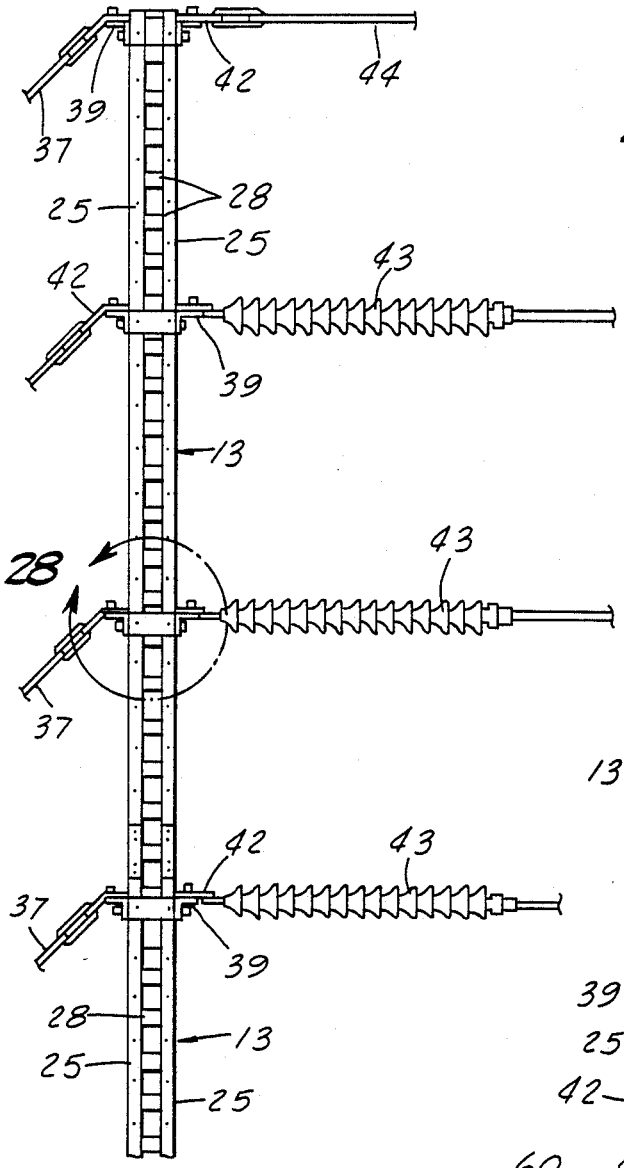
FIG. 20 is an elevational view of the upper end of a tower assembly employed as a dead end anchorage for three power conductors.
Figure 21:
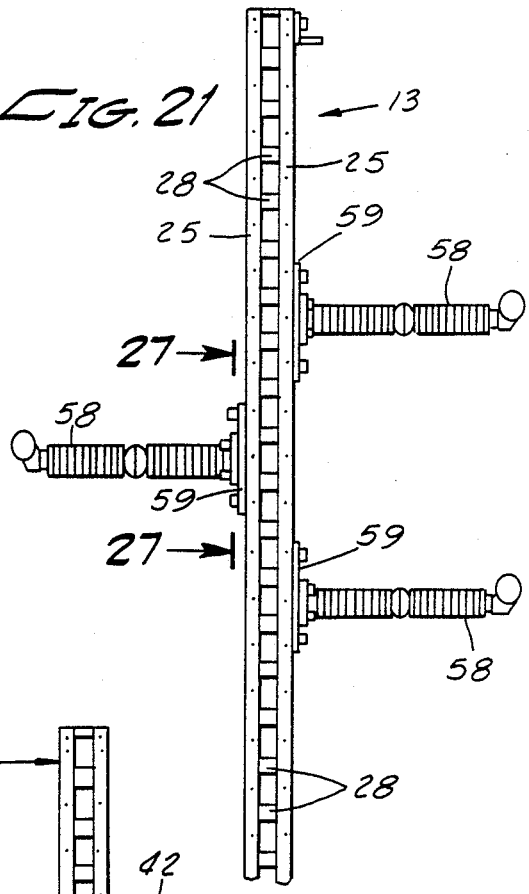
FIG. 21 is the view of the upper end of a power structure showing a different mode of supporting three insulators cantilever fashion on opposed sides of the tower.
Figure 22:
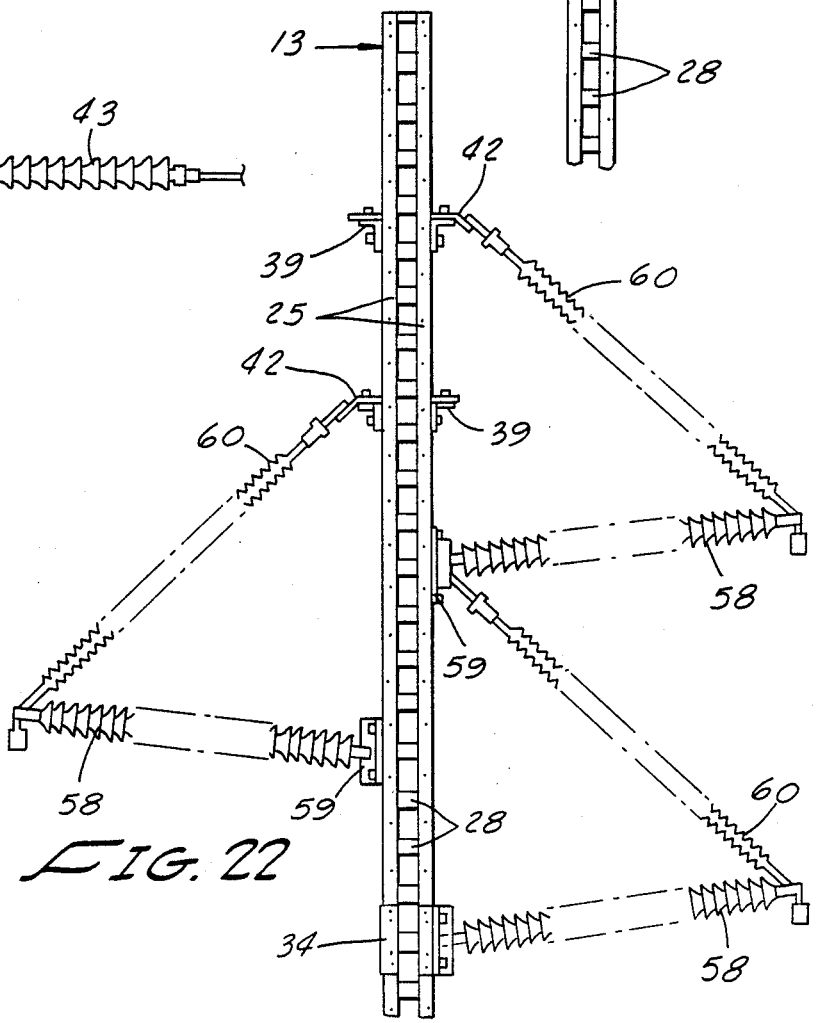
FIG. 22 is a view similar to FIG. 21 but showing a different mode of supporting the insulators cantilever fashion.
Figure 27:
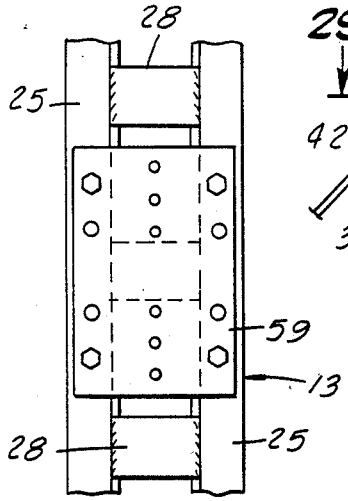
FIG. 27 is a fragmentary view on an enlarged scale taken along line 27—27 on FIG. 21.
Figure 28:
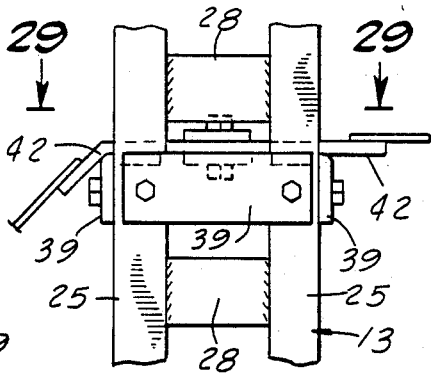
FIG. 28 is a side view on an enlarged scale of the zone indicated by 28 in FIG. 20.
Figure 29:
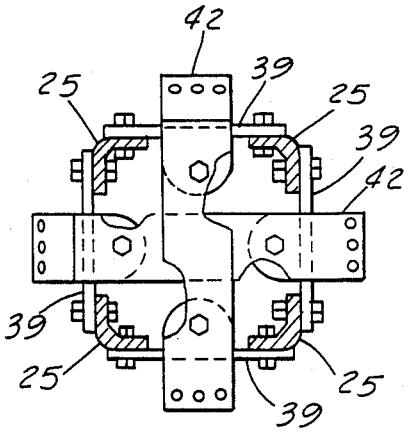
FIG. 29 is a cross sectional view taken along line 29—29 on FIG. 28.
Figure 23:
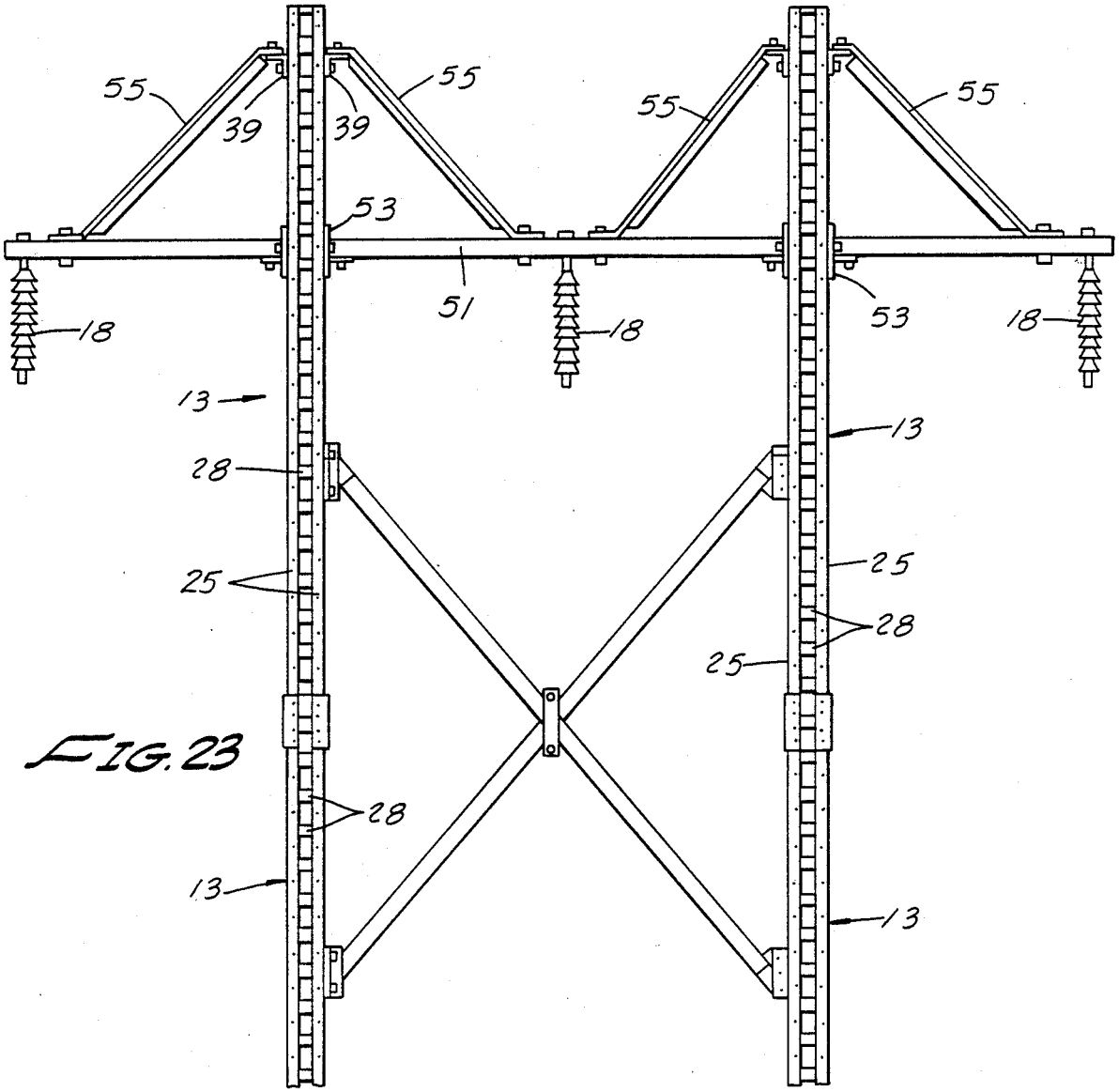
FIG. 23 is an elevational view of a pair of the invention towers in side-by-side relation and cooperating to support three insulators from a common cross arm.

If cantilever type insulators 58 are to be employed their base plates are anchorable to plates 59 best shown in FIG. 6 having their opposite lateral edges bolted to corner members 25 of a tower section 13 such as in the manner illustrated in FIGS. 19 and 21. Cantilever insulators 58 can be mounted on the same side of the tower as shown in FIG. 19, or on the opposite sides as shown in FIGS. 21 and 22. In some cases, it is desirable to provide additional support for the outer end of a cantilever insulator, such as by an inclined insulator 60 connected to the tower in the manner clearly shown in FIG. 22.

Figure 30B:
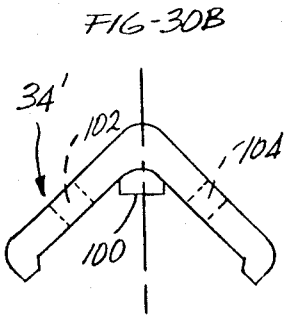
FIGS. 30A and 30B are side sectional and end plan views, respectively, of an angle iron coupling that incorporates shear resistive teeth.
Figure 31B:
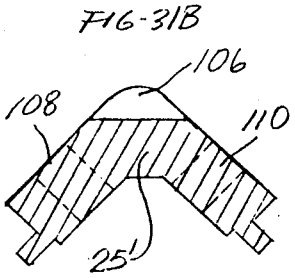
FIGS. 31A and 31B are side sectional and end sectional views, respectively, of a corner member of a modular tower of the invention illustrating meshing shear resistive teeth.
Figure 30A:
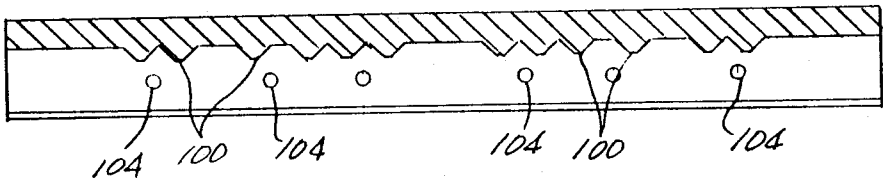
Figure 31A:
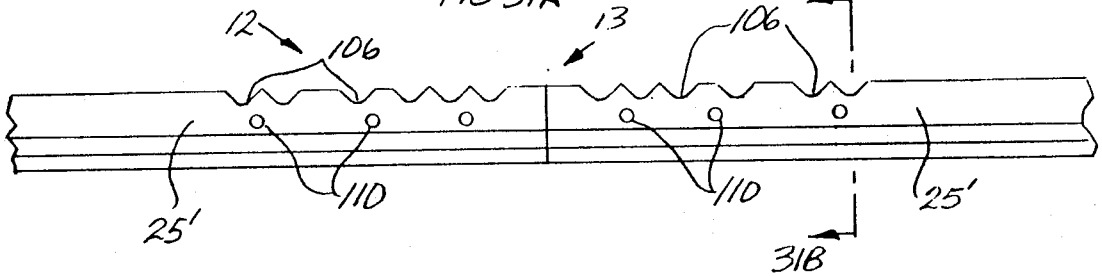
Figure 32:
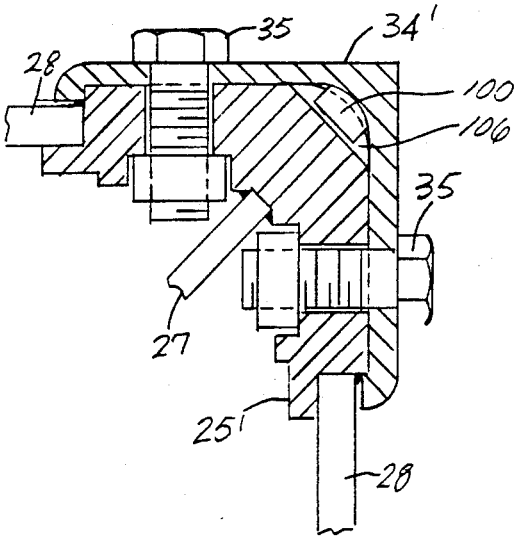
FIG. 32 is a modification of FIG. 17 showing shear resistive teeth on an angle iron coupling and a corner member of the module.

In order to prevent the couplings from slipping and tilting the tower form a straight vertical orientation due to shear force exerted by loads on the tower, meshing teeth are formed on the couplings and the overlapping surfaces of the interconnected modules. These teeth provide a metal-to-metal bearing contact that resists slipping. In FIGS. 30A and 30B a modified angle iron 34' has a plurality of teeth-forming transverse protrusions 100 spaced along the length of its interior apex. Angle iron 34' has a plurality of bolt holes 102 spaced along the length of one leg and a plurality of bolt holes 104 spaced along the length of the other leg. In FIGS. 31A and 31B a modified corner member 25' has a plurality of teeth forming transverse grooves 106 spaced along the length of its exterior apex. Corner member 25' has a plurality of bolt holes 108 spaced along the length of one leg and a plurality of bolt holes 110 spaced along the length of the other leg. Protrusions 100 and grooves 106 are distributed so that they fit together, i.e. the teeth formed thereby mesh. Likewise holes 102 and 104 are in registration with holes 108 and 110, respectively, when the ends of the modules abut each other and angle iron 34' is in place. As depicted in FIG. 31B, grooves 106 are rounded to relieve stress at the apex of corner member 25'. In order to distribute the stress evenly along the length of angle iron 34' and corner members 25', protrusions 100 and grooves 106 are more closely spaced together near the abutting ends of the modules as illustrated in FIG. 30A. Holes 102, 104, 108 and 110 are staggered to increase the strength of the joint.

From the foregoing it is apparent that this invention provides a highly versatile kit of simple, rugged, easily manufactured long life components selectively usable in a variety of manners to provide a rigid heavy load-supporting structure not only for power lines but for many other applications. The main tower units are preassembled at the factory and readily transported to the erection site by light weight cargo carriers or by helicopter. The modules are readily assembled in end-to-end relation by simple equipment or lowered into field assembly position by helicopter. The cross arm units are simple and easily secured crosswise of the tower as is guy cabling.

While the particular lightweight power line tower kit herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A kit for the assembly at an erection site of a lightweight modular power line tower or the like load supporting structure comprising:

a plurality of factory prefabricated elongated generally tubular tower units formed primarily of a strong lightweight material including at least one ground supportable unit and at least one other unit;

means for securing said tower units rigidly together in axially aligned relation at the erection site, the securing means comprising a plurality of couplings adapted to secure said tower units in abutting end to end relationship with the couplings overlapping portions of the length of the tower units adjacent their abutting ends when assembled, means for securing the couplings to portions of the tower units, and at least one column of teeth formed along the length of each coupling and matching teeth formed along the portions of the tower units; and means for securing insulated power line support means to a climbable one of said tower units.

2. A kit as defined in claim 1 characterized in that said other tower unit has openings transversely of axially spaced apart areas adapted for occupation by elongated load supporting means extending transversely of said other tower unit and including means for clamping said load supporting means to said other tower unit.

3. A kit as defined in claim 2 characterized in that said load supporting means is tubular in cross section.

4. A kit as defined in claim 1 in which the other tower unit has sides characterized in the provision of means anchorable to one side of said other tower unit for securing one end of a high tension insulator thereto.

5. A kit as defined in claim 1 characterized in the provision of a pair of high tension insulators each having an inboard end and an outboard end and first and second means rigidly clampable to axially spaced apart points on said other tower unit for supporting the pair of high tension insulators in a vertical plane from one side of said tower unit with the inboard ends of said insulators anchored to a respective one of said first and second means and the outboard ends thereof connected together.

6. A kit as defined in claim 5 characterized in the provision of third means rigidly clampable to said other tower unit axially spaced from one of said first and second means and utilizable therewith to similarly support a second pair of high tension insulators.

7. A kit as defined in claim 5 characterized in the provision of fourth and fifth means rigidly clampable to the opposite side of said other tower unit from said first and second means, said fourth and fifth means being clampable to said tower unit in axially spaced relation and operable to similarly support a third pair of high tension insulators.

8. A kit as defined in claim 1 characterized in the provision of means for rigidly clamping an elongated high tension insulator to one of the other units in cantilever fashion.

9. A kit as defined in claim 1 in which the tower units each have a plurality of sides characterized in the provision of separate means for rigidly clamping a plurality of axially spaced apart high tension insulators to said other tower unit in cantilever fashion.

10. A kit as defined in claim 9 characterized in that some insulator clamping means are on one side of said tower unit and the rest on the opposite side thereof.

11. A kit as defined in claim 9 characterized in that all of said insulator clamping means are located on the same side of said tower unit.

12. A kit as defined in claim 1 additionally comprising base anchorage means for said ground supportable tower unit comprising an elongated tubular member adapted to be buried upright;

plate means attached crosswise at the upper end of the tubular member;

a plurality of upright angle members arranged in a ring with one end secured to said plate means; and fastener means adapted to clamp said angle members to said ground supportable tower unit.

13. A kit as defined in claim 1 characterized in that said tower units include diagonal cross braces at axially spaced apart points therealong.

14. A kit as defined in claim 1 characterized in that said tower units include a plurality of members extruded from aluminum and coextensive in length with said tower units; and including means for holding said members rigidly welded to one another.

15. A kit as defined in claim 14 characterized in that the extruded members of said ground supportable unit are spaced apart and rigidly interconnected by welding to bridging plate means effective to thwart attempts of unauthorized persons to ascend said tower.

16. A kit as defined in claim 14 characterized in that said extruded members of said ground supportable tower unit are interconnected at spaced apart levels by aluminum structural bracing strips and serving additionally as foot steps for use by workmen engaged in tower erection and servicing operations.

17. A kit as defined in claim 16 characterized in that said bracing strips cooperate with said extruded members in forming aligned pairs of transverse openings crosswise of said other tower units useful in providing supports for other components including cross arms.

18. A kit as defined in claim 14 characterized in that said extruded members include groove means opening inwardly and sized to seat and hold, against rotation, means having threaded openings for threaded fasteners.

19. A kit for the assembly at the erection site of a lightweight modular power line tower or the like load supporting structure comprising:

a plurality of factory prefabricated elongated generally tubular tower units formed primarily of a strong lightweight material including at least one ground supportable unit and at least one other unit;

means for securing said tower units rigidly together in axially aligned relation at the erection site; and a foundation unit comprising a tube adapted to be anchored in the ground in an upright position and a plurality of upright angle irons secured to the upper end of the tube and adapted to receive one end of the ground supportable unit in an upright position.

20. A kit as defined in claim 1 additionally comprising fittings adapted to be bolted to said other tower unit to facilitate connection of a guy line to said tower.

21. A kit as defined in claim 1 characterized in that said ground supportable tower unit comprises a plurality of elongated generally parallel extruded aluminum, corner members arranged to form adjacent lateral edges and imperforate plates welded to the adjacent lateral edges to provide a unitary tubular housing having a generally continuous exterior surface.

22. A kit as defined in claim 1 additionally comprising a foundation unit comprising a tube adapted to be anchored in the ground in an upright position; and means secured to the upper end thereof adapted to secure the lower end of said ground supportable tower unit thereto in an upright position.

23. The kit of claim 1 in which the material is aluminum.

24. The kit of claim 23 in which the ground supportable unit has a closed outer surface.

25. The kit of claim 24 in which the other unit has a lattice work outer surface.

26. The kit of claim 22 in which the securing means comprises a plurality of upright angle irons for receiving one end of the unclimbable unit.

27. A lightweight modular power line tower comprising:

a foundation module buried in the ground at an installation sight;

an axially elongated first tower module having an imperforate outer surface;

means for removably securing the first tower module to the foundation module to extend upwardly from the ground;

an axially elongated second tower module having an open outer surface, the first and second modules being in end to end abutting relationship;

coupling means overlapping and interlocking with portions of the length of the first and second modules thereby removably securing the second tower module to the first tower module to extend upwardly therefrom in axial alignment, the coupling means being interlocked by a column of teeth along its length that mesh with teeth on the modules;

at least one electrical insulator; and means for attaching the electrical insulator to the second tower module.

28. The modular tower of claim 27 in which the second tower module comprises a plurality of interconnected units removably secured together.

29. The modular tower of claim 27 in which the foundation module comprises a tube buried in the ground and a plurality of angle irons spaced to receive the first tower module.

30. The modular tower of claim 27 in which the attaching means is a cross arm extending outwardly from the second tower module.

31. The tower of claim 27 in which the modules each have four corner members and the coupling means are angle irons that overlap the respective corner members adjacent the abutting ends of the modules.

32. The tower of claim 27 in which the modules each have four mutually perpendicular faces and the coupling means are bridging plates that overlap the respective faces adjacent the abutting ends of the modules.

33. The tower of claim 27 in which the teeth on each coupling means are formed by protrusions from the surface of such coupling and the teeth on each module are formed by grooves formed in the surface of such module.

34. A kit for the assembly at the erection site of a lightweight modular power line tower or the like load supporting structure comprising:

a plurality of factory prefabricated elongated generally tubular tower units formed primarily of a strong lightweight material including at least one ground supportable unit and at least one other unit;

means for securing said tower units rigidly together in axially aligned relation at the erection site;

base anchorage means for said ground supportable tower unit comprising an elongated tubular member adapted to be buried upright;

plate means attached crosswise at the upper end of the tubular member;

a plurality of upright angle members arranged in a ring with one end secured to said plate means; and fastener means adapted to clamp said angle members to said ground supportable tower unit.

35. A kit for the assembly at an erection site of a lightweight modular power line tower or the like load supporting structure comprising:

a plurality of factory prefabricated elongated generally, tubular tower units formed primarily of a strong lightweight material including at least one ground supportable unit and at least one other unit, said tower units including a plurality of members extruded from aluminum and coextensive in length with said tower units, means for holding said extruded members rigidly to one another, fastener means comprising threaded nuts and bolts adapted to connect the tower units end to end, openings passing through the extruded members to receive the bolts, and groove means in said extruded members opening inwardly at the openings and sized to seat and hold the nuts against rotation;

a plurality of couplings adapted to secure said tower units in abutting end to end relationship with the coupling overlapping portions of the length of the tower units adjacent their abutting ends when assembled, openings passing through the couplings to receive the bolts; and means for securing insulated power line support means to the other tower unit.

36. A kit as defined in claim 35 characterized in that said means with threaded openings comprises an elongated member provided with means for holding the same captively assembled lengthwise of said groove in said extruded member; and said elongated member having a plurality of threaded openings distributed therealong and in registry with a respective opening through said extruded member.

* * * * *